US007665235B2

(12) United States Patent
Latham

(10) Patent No.: US 7,665,235 B2
(45) Date of Patent: Feb. 23, 2010

(54) TOOTHED TRENCHER TRACK AND ELEMENTS THEREFOR

(75) Inventor: Winchester E. Latham, Avon, IN (US)

(73) Assignee: Keystone Engineering and Manufacturing Corporation, Avon, IN (US)

( * ) Notice: Subject to any disclaimer, the term of this patent is extended or adjusted under 35 U.S.C. 154(b) by 13 days.

(21) Appl. No.: 12/051,344

(22) Filed: Mar. 19, 2008

(65) Prior Publication Data

US 2008/0235997 A1 Oct. 2, 2008

Related U.S. Application Data

(60) Provisional application No. 60/920,948, filed on Mar. 30, 2007, provisional application No. 60/978,879, filed on Oct. 10, 2007.

(51) Int. Cl.
*E02F 3/24* (2006.01)

(52) U.S. Cl. ..... 37/452; 37/465

(58) Field of Classification Search ..... 37/465, 37/352–357, 362, 366, 386, 387, 462–464; 299/39.4, 39.7–39.9, 76, 78, 67; 404/90, 404/91

See application file for complete search history.

(56) References Cited

U.S. PATENT DOCUMENTS

| | | | | |
|---|---|---|---|---|
| 2,749,105 A | | 6/1956 | Sibley | 262/29 |
| 3,319,364 A | | 5/1967 | Evans | 37/86 |
| 3,913,979 A | * | 10/1975 | Strauss et al. | 299/84.1 |
| 4,363,178 A | | 12/1982 | Erickson | 37/191 A |
| 4,404,761 A | * | 9/1983 | Paulin et al. | 37/465 |
| 4,626,032 A | | 12/1986 | Harris et al. | 299/36 |
| 4,775,189 A | | 10/1988 | Den Besten | 299/82 |
| 5,497,567 A | | 3/1996 | Gilbert | 37/352 |
| 6,397,501 B1 | | 6/2002 | Lembcke | 37/465 |
| 6,536,143 B2 | | 3/2003 | Lembcke | 37/465 |
| 6,832,443 B1 | * | 12/2004 | Piel et al. | 37/352 |
| 6,925,736 B2 | | 8/2005 | Taki | 37/352 |
| 7,152,348 B2 | | 12/2006 | Unzicker et al. | 37/352 |
| 7,290,360 B2 | | 11/2007 | Unzicker et al. | 37/352 |

* cited by examiner

*Primary Examiner*—Robert E Pezzuto
(74) *Attorney, Agent, or Firm*—Brinks Hofer Gilson & Lione

(57) ABSTRACT

An endless chain for cutting and removing spoil from a trench includes a plurality of links pivotally coupled together. A plurality of flight plates are secured to the plurality of links. A pattern of openings extends through each flight plate between the under surface and the outer surface. A plurality of wear plates is positioned over the outer surface of the plurality of flight plates. A plurality of fasteners pass from the under surface of the flight plate through at least some of the pattern of openings in the flight plate and into the wear plate to secure the wear plate to the flight plate. The fasteners securing the wear plates to the flight plates can have outer ends that terminate short of the outer surface of the wear plates in openings in the under surface of the wear plate. Sockets, which include bores receiving cutting elements, can be fixed to the wear plates with a bottom surface of the socket either angled with respect to or flush with the wear plate outer surface.

25 Claims, 15 Drawing Sheets

TOOTHED TRENCHER TRACK AND ELEMENTS THEREFOR

CROSS-REFERENCE TO RELATED APPLICATIONS

This application is related to and claims all available benefits from U.S. Provisional Application Ser. No. 60/920,948 filed Mar. 30, 2007, and U.S. Provisional Application Ser. No. 60/978,879 filed Oct. 10, 2007.

BACKGROUND

1. Field of the Invention

This invention generally relates to apparatus for digging ditches and trenches. This invention particularly relates to apparatus having a continuous chain to which excavating elements are secured, the chain and excavating elements being suitable for removing hard soils and rock to form a ditch or trench. This invention more particularly relates to track elements secured to a continuous chain that permit a more desirable distribution of cutting or mining teeth that will provide for superior performance of a trencher using such track elements.

2. Background of the Invention

A commonly used type of chain ditcher is characterized by an elongated boom mounted on a supporting structure such as a tractor. The boom is pivoted to the tractor and is provided at both ends with one or more sprockets, around which a heavy chain passes. Plates are bolted to the links of the heavy chain. Sockets are welded to the plates in a more or less orderly pattern such that when cutting teeth are placed in the sockets, the cutting surfaces of the teeth will cover substantially the entire width of the ditch to be dug at least once in a complete revolution of the chain around the boom. Rotation of the chain as the boom is lowered causes the cutting teeth to abrade and chip away the material in front of the chain until the boom reaches the desired depth and cutting angle. The bottom of the ditch is generally cut by the cutting surfaces of the teeth on each plate as the plate rounds the end of the boom. The entire unit is then moved slowly forward so that the ditch is elongated at full depth in the direction taken by the tractor. As the unit is moved forward, the cutting surfaces of the teeth on the plates bolted to the chain engage substantially the entire face of ditch. Of course, only the tooth points actually touch the face of the ditch, but all the points on the chain along the entire face of the ditch are being advanced at the rate of the advance of the tractor, therefore, all the points are sharing approximately equal parts of the total effort available to rotate the chain and to advance the chain against the face of the ditch.

Each tooth scours a substantially linear path up the face of the ditch as the chain is rotated by the sprockets. With sufficient contact pressure, the teeth penetrate into the soil and rock to chip and route spoil from the face of the ditch and the ditching is accomplished at a meaningful rate. Chips and other spoil materials are lifted out of the ditch by the drag and impact forces imparted in an upward direction along the face of the ditch by the rapid rotation of the chain. It is important that the teeth be evenly distributed to assure an efficient ripping and cutting action on the ditch face. However, in some equipment, the bolts securing the plates to the chain prohibit the use of some locations for sockets to receive the cutting teeth. Consequently, the sockets are often situated in undesirable locations forward and rearward of the midline of each supporting plate, and twisted or angled in an attempt to locate the tooth points at the desired location. The forward and rearward displacement of the cutting teeth on each plate causes an unintended change in cutting angle at the very bottom of the trench or ditch. Further, this twisting and angling of the sockets results in the teeth being presented at an incorrect or awkward cutting angle even on the ditch face that can contribute to uneven tooth wear and can slow down the trenching process. Additionally, any portion of the bolts securing the plates to the chain that protrude above the outer surface of the plates is subjected to abrasive wear by the spoil materials.

Thus, there remains a need for a trencher track that can allow for the uniform positioning and angling of the tooth holding sockets so that an optimum cutting action can be achieved and the teeth life sustained for a longer period of time. There also remains a need for tooth holding sockets that can be fixed to the outer surface of the trencher track at any desired location while reliably retaining the desired cutting attack angle.

SUMMARY

An endless chain for cutting and removing spoil from a trench includes a plurality of links pivotally coupled together. A plurality of flight plates are secured to the plurality of links. Each of the flight plates have an under surface confronting the links and an outer surface obverse with respect to the under surface. A pattern of openings extends through each flight plate between the under surface and the outer surface. A plurality of wear plates is positioned over the outer surface of the plurality of flight plates. Each wear plate has at least one cutting element mounted onto an outer surface of the wear plate. A plurality of fasteners pass from the under surface of the flight plate through at least some of the pattern of openings in the flight plate and into the wear plates to secure the wear plates to the flight plates.

The endless chain can include more than one set of links coupled end to end, with the flight plates laterally coupling the sets of links together. Each of the flight plates can be secured to the links of the endless chain by a set of fasteners passing from the flight plate outer surface through some of the openings in each flight plate. The heads of the fasteners can be recessed into the flight plate outer surface to permit flush mounting of the wear plates to the flight plates.

The fasteners securing the wear plates to the flight plates can have outer ends that terminate at or short of the outer surface of the wear plates. The outer ends of the fasteners securing the wear plates to the flight plates can be received in openings in the under surface of the wear plate, which can be blind openings, in which case the outer surface of the wear plates can be smooth and continuous from edge to edge. Since the outer ends of the fasteners are situated at or short of the outer surface, the tooth receiving sockets can be located at any location on the outer surface of the wear plate.

In one aspect, a flight plate intended to be an interface between an endless chain and a wear plate supporting a cutting element has outer and inner obverse surfaces and a plurality of openings extending between the outer and inner surfaces. One set of the plurality of openings can include recesses sized to completely receive the heads of fasteners adapted to couple the flight plate to the endless chain. Another set of the plurality of openings is provided to receive fasteners for coupling the wear plate to the flight plate so that the inner surface of the wear plate is contiguous to the outer surface of the flight plate.

In another aspect, a wear plate can have a smooth planar outer surface permitting the attachment socket for receiving a tooth or other cutting element at any location on the wear plate outer surface. The inner surface of the wear plate includes a pattern of holes adapted to receive the outer ends of a plurality of fasteners the pass through an adjacent flight plate. Each of the holes in the pattern of holes can be a blind hole so that the continuous character of the outer surface of the wear plate is maintained.

In another aspect, an inner surface of the wear plate includes a pattern of holes adapted to receive the outer ends of a plurality of fasteners the pass through an adjacent flight plate. Each of the fasteners can have a length chosen such that when the plates are secured together, the outer end of each fastener does not extend beyond the outer surface of the wear plate. Sockets to receive the cutting teeth can be fixed to the outer surface of the wear plate at any desired location, but are preferably secured in a longitudinal mid-region of the plate to maintain the cutting angle of the teeth within a preferred range at the bottom of the trench cut. Variation in cutting angle can be achieved by adding an angle control pin to a lower surface of the socket prior to fixing the socket to the wear plate outer surface.

The above, as well as other advantages of the present invention, will become readily apparent to those skilled in the art from the following detailed description of a preferred embodiment when considered in the light of the accompanying drawings.

DESCRIPTION OF PREFERRED EMBODIMENTS

Figure 1:
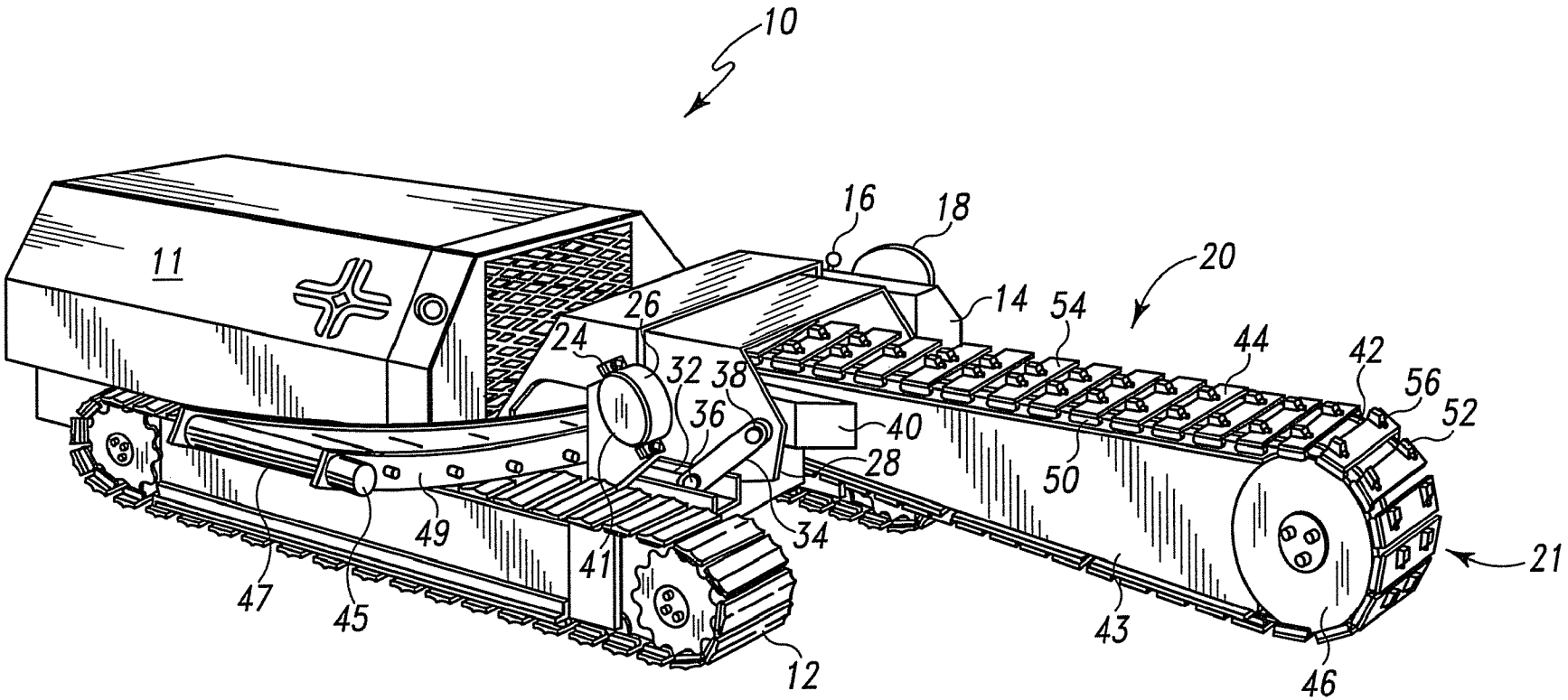
Fig. 1 Prior Art
FIG. 1 is a perspective view of a prior art trencher traction unit on which flight plates and wear plates of the present invention could be used.

A typical prior art trencher traction unit 10 shown in FIG. 1 includes a power source 11 that is coupled to tracks 12 for forward and rearward motion of the traction unit 10 under the power provided by the power source. A console 14 can be provided with controls 16 so that an operator can operate the unit 10 from chair 18. The traction unit 10 has an elongate boom assembly 20 having an inner end pivotally mounted to the traction unit 10 on a shaft that is journaled to the traction unit 10 by flanges 24 and 26 on the traction unit 10 and the hood 28. The boom assembly 20 has an outer end 21 that can be raised or lowered under the influence of hydraulic cylinders having one end secured to the traction unit 10, and having a connecting rod 32 pivotally mounted to arm 34 on axle 36. The arm 34 can be pivotally mounted to the cross-bar 38, which passes through the hood 28 and boom assembly 20 so that the hood 28 can be raised and lowered simultaneously with the changes of elevation in the outer end 21 of the boom assembly 20. The cross-bar 38 can be journaled within the reinforcement box 40, which is integral with the rest of the boom assembly 20, so that extension or retraction of the connecting rod 32 by the hydraulic cylinder will cause corresponding elevation or lowering of the outer end 21 of the boom assembly 20.

The boom assembly 20 includes an endless chain 42 and a plurality of plates 44 are coupled to the endless chain 42 for movement with the chain. Each plate 44 has at least one socket 52 welded or otherwise fixed to an outer surface 54 of the plate 44 at a selected location between the lateral ends 50 of the plate 44. The socket 52 is adapted to receive a tooth or other cutting element 56. A hydraulic motor 41 is provided to rotate the endless chain 42 around the sprocket 46 at the outer end 21 of the boom assembly 20 and along the top and bottom of the boom assembly 20. The movement of the chain 42 by the motor 41 together with a downward displacement of the outer end 21 of boom assembly 20 causes the cutting elements 56 to dig a trench below the boom assembly 20. The rotation of the endless chain 42 draws the spoil from the trench toward the hood 28. The side plates 43 of the boom assembly 20 are intended to restrict intrusion of the spoil into the interior of the boom assembly 20. The trencher 10 is also be provided with a hydraulic motor 45 to rotate the endless belt 47 of conveyor 49 to remove the spoil which is pulled up out of the trench being dug by the boom assembly 20.

Figure 2:
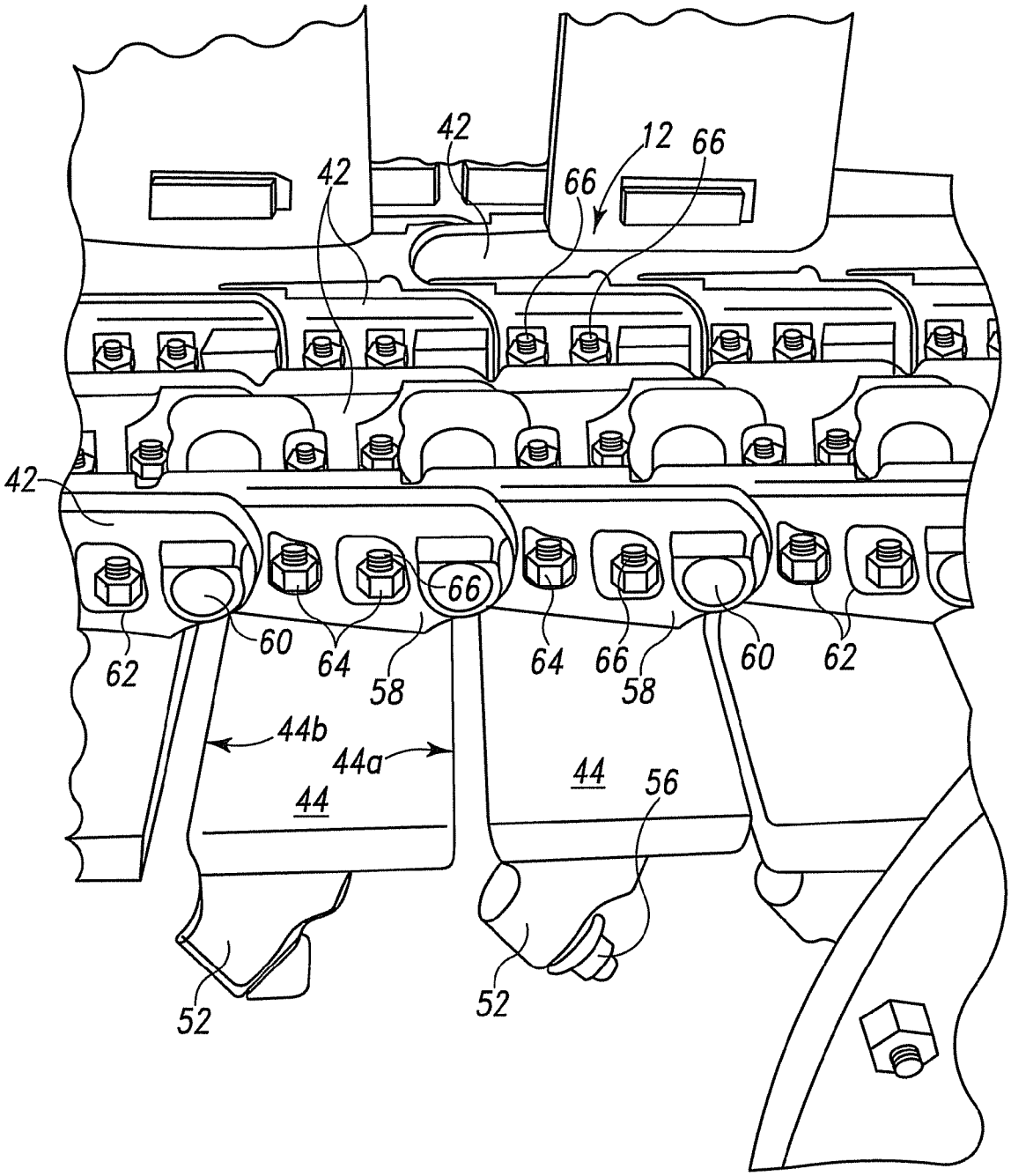
Fig. 2 Prior Art
FIG. 2 is a detail perspective view of a portion of a prior art trencher track on which flight plates and wear plates of the present invention could be used.

FIG. 2 is a close-up side perspective view of a portion of a typical prior art trencher track such as track 12. The track 12 can be seen to have a plurality of endless chains 42, each chain 42 being composed of a plurality of links 58 pivotally coupled end to end to each other by pivot rods 60. Each link 58 also seen to include a pair of recesses 62, each recess receiving a threaded nut or other similar fastener 64. The track 12 also has a plurality of plates 44, each plate 44 being coupled to a lateral array of the links 58 by bolts or other threaded members 66 which pass through the plate 44 into one of the recesses 62 to engage one of the fasteners 64. Each plate 44 has at least one socket 52 welded or otherwise fixed to an outer surface 54 of the plate 44 between the leading edge 44*a* and trailing edge 44*b* of the plate 44. Each socket 52 is adapted to receive a tooth or other cutting element 56. A preferred socket 52 is detailed below in connection with FIGS. 7-12.

Figure 3:
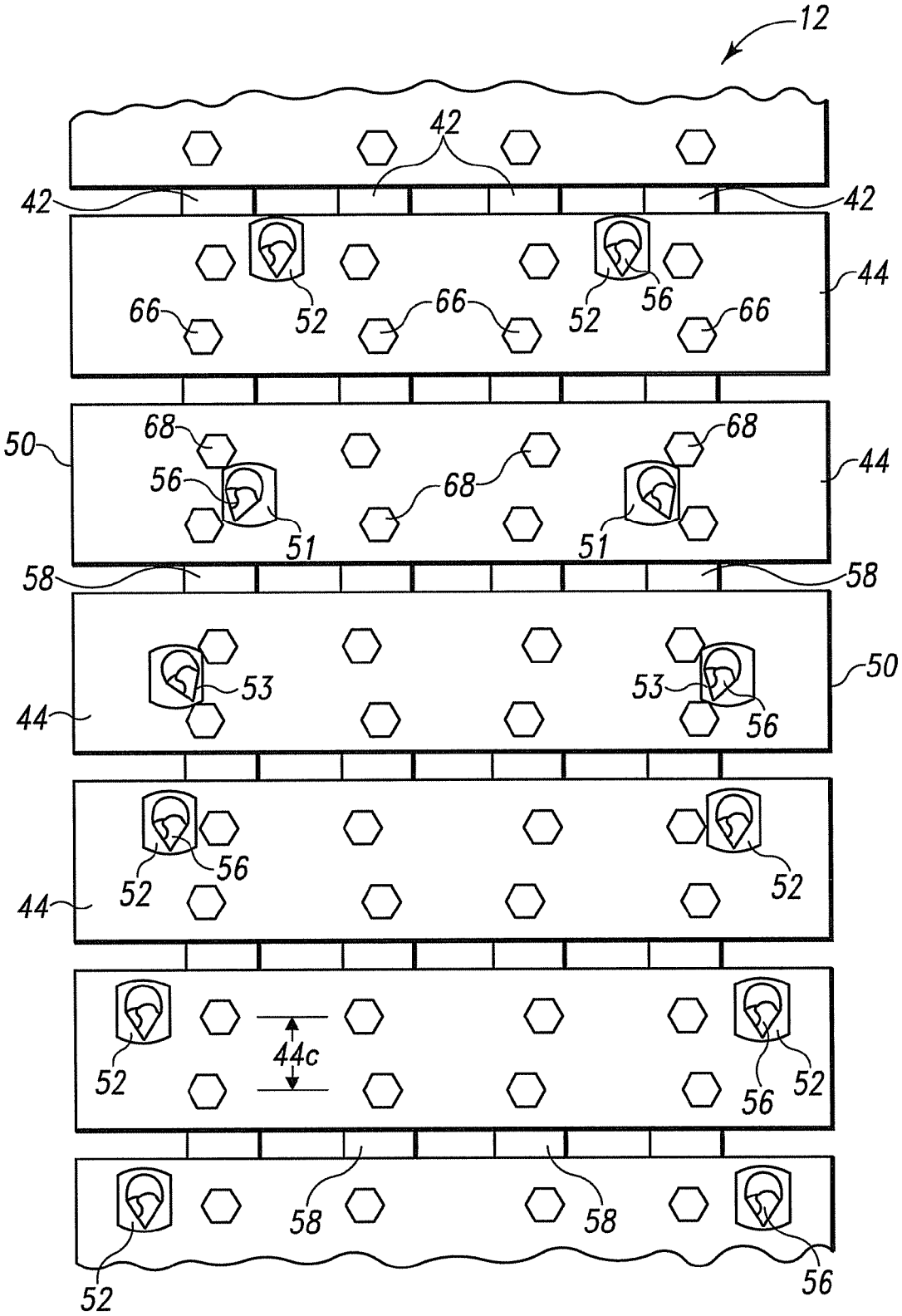
Fig. 3 Prior Art
FIG. 3 is a plan view of a portion of a prior art toothed trencher track illustrating a problem.

FIG. 3 shows a plan view of a portion of the prior art toothed trencher track 12 including a plurality of plates 44 secured to the underlying links 58 of the chains 42 by the bolts or other threaded members 66. The heads 68 of the bolts 66 are situated at substantially the same position on every plate 44 and define a mid-region 44*c* of the plate 44 that is between the two rows of bolts 66. The sockets 52 are shown to be arrayed at varying positions laterally along each plate 44, the positions being selected to distribute the points of the teeth or other cutting elements 56 between plate ends 50 across the width of the track 12 at a substantially constant spacing. It will also be noted that sockets 52 are shown in FIG. 3 to be located in a trailing region adjacent the trailing edge 44*b* of each plate 44 while the sockets 51 and 53 are located in the mid-region 44*c* of the plate 44. It will also be noted however that sockets 51 and 53 are somewhat skewed to achieve the desired constant spacing of the cutting elements 56, the skewing being necessary due to the positioning of the bolt heads 68.

An alternative solution used in the prior art to avoid the skewing of sockets 51 and 53 is to displace the sockets significantly forward or rearward of the mid-region 44*c* of the plate 44. By moving the sockets to be immediately adjacent the leading and trailing edges of the plate 44, the heads 68 of the bolts 66 presented less obstruction so that any desired lateral positioning of the sockets 52 could be achieved with little or no skewing. The forward and/or rearward displacement of the sockets 52 on the plate 44 has negligible impact on the cutting attack angle in relation to a trench face that is being cut. However, as will be seen later, the same forward and/or rearward displacement of the sockets 52 on the plate 44 has a significant impact on cutting attack angle at the bottom of the ditch or trench as each plate 44 is caused to go around the sprocket 46 at the curved outer end 21 of the boom 20.

Figure 4:
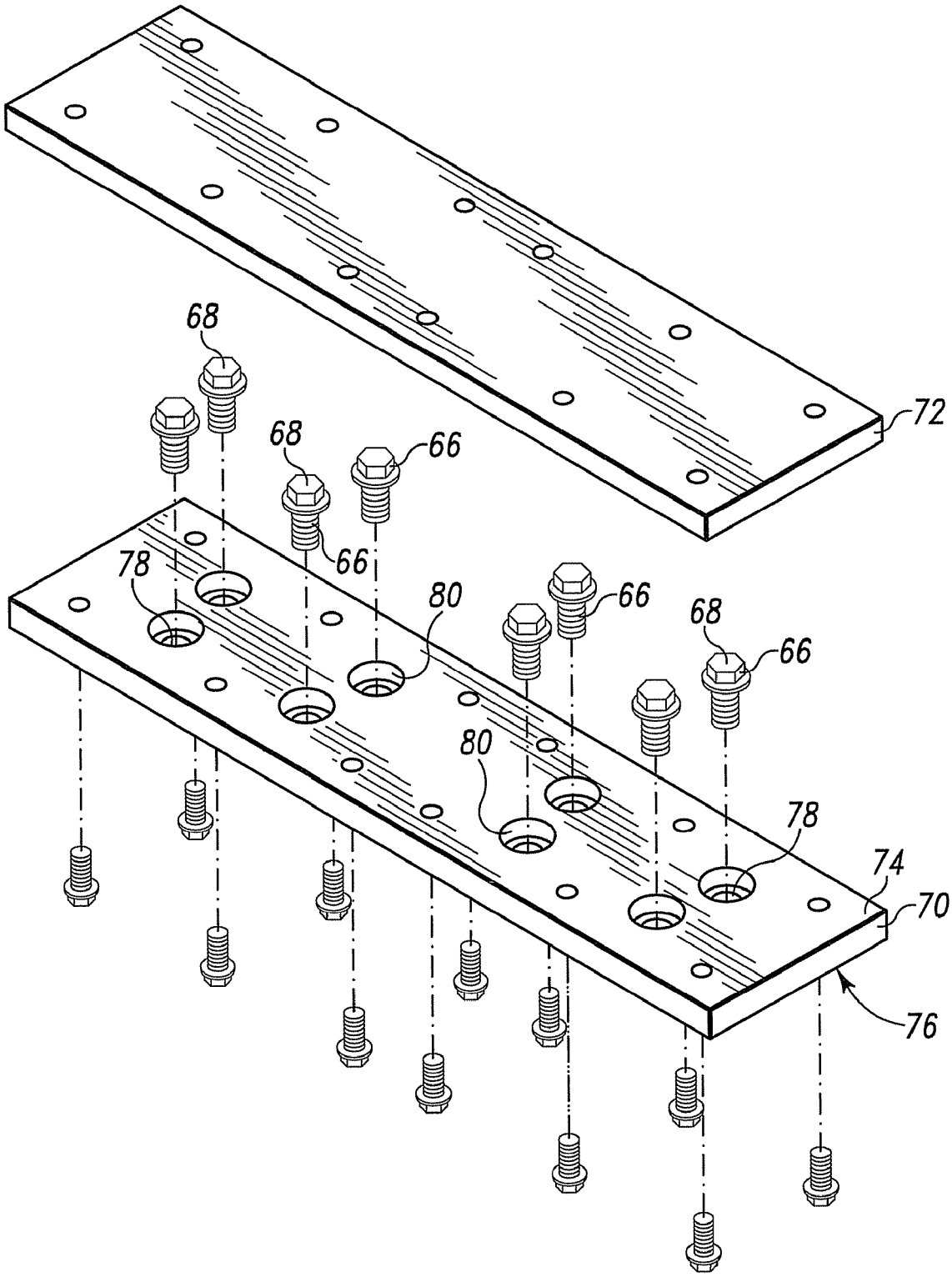
FIG. 4 is an exploded perspective view of a flight plate and a wear plate of the present invention along with the related fasteners.
Figure 5:
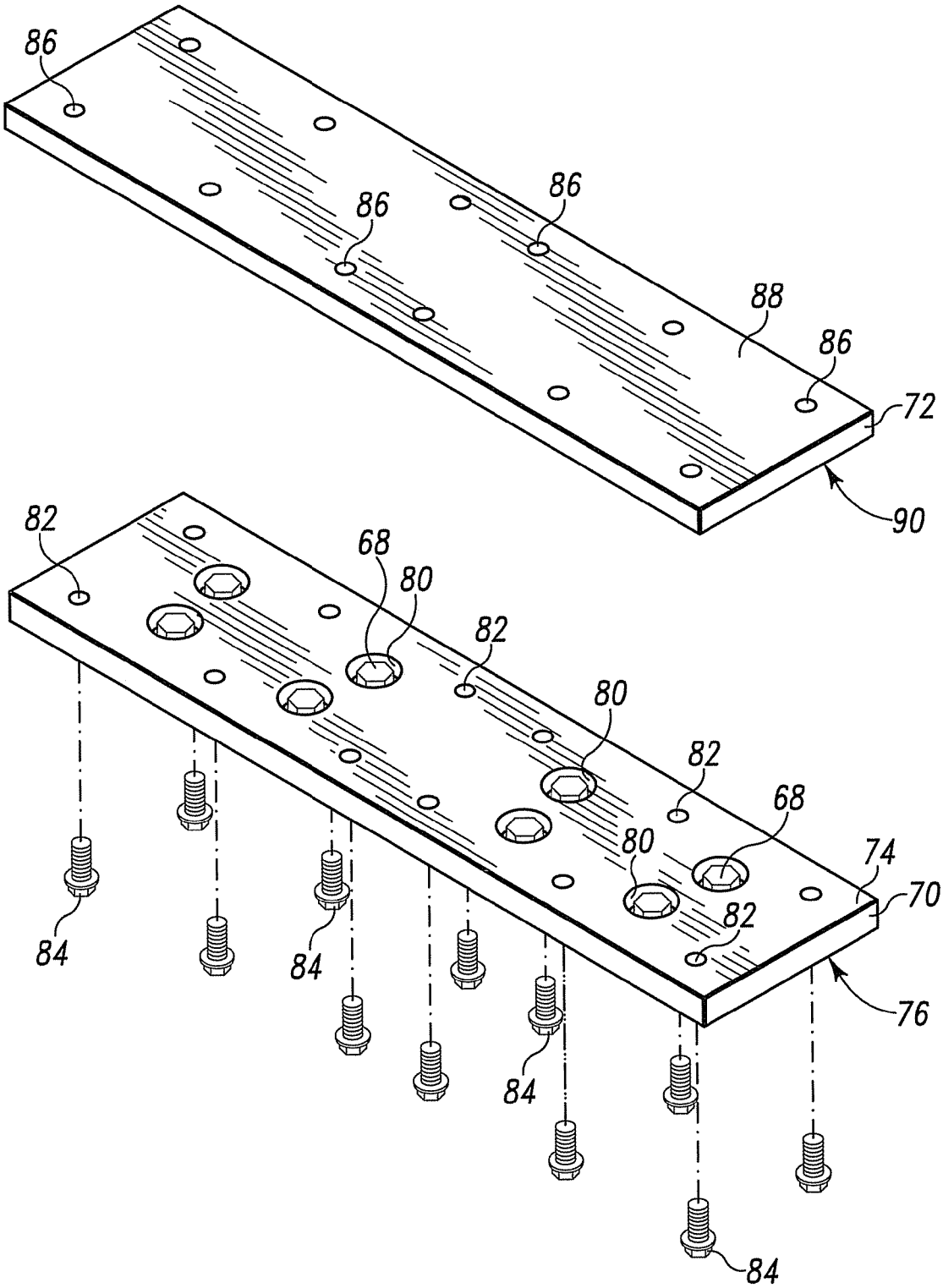
FIG. 5 is a view similar to FIG. 4 with the fasteners adapted to couple the flight plate to an underlying chain shown in an installed position.

FIG. 4 shows an exploded perspective view of a flight plate 70 and a wear plate 72 of the present invention along with the related fasteners. The flight plate 70 has an outer surface 74 and an inner surface 76, the inner surface 76 being intended to contact and be coupled to the links 58 of one or more chains 42 in the same manner as shown in FIG. 2. A first set of openings 78 passes between the outer surface 74 and the inner surface 76 of the flight plate 70. The first set of openings 78 are positioned to receive threaded members 66 to secure the flight plate 70 to the fasteners 64 in the links 56 of the endless chain 42 in the same manner as shown in FIG. 2. The first set of openings 78 includes recesses 80 into the outer surface 74 of the flight plate 70 to receive entirely a head portion 68 of the bolts 66 as shown in FIG. 5.

Figure 6:
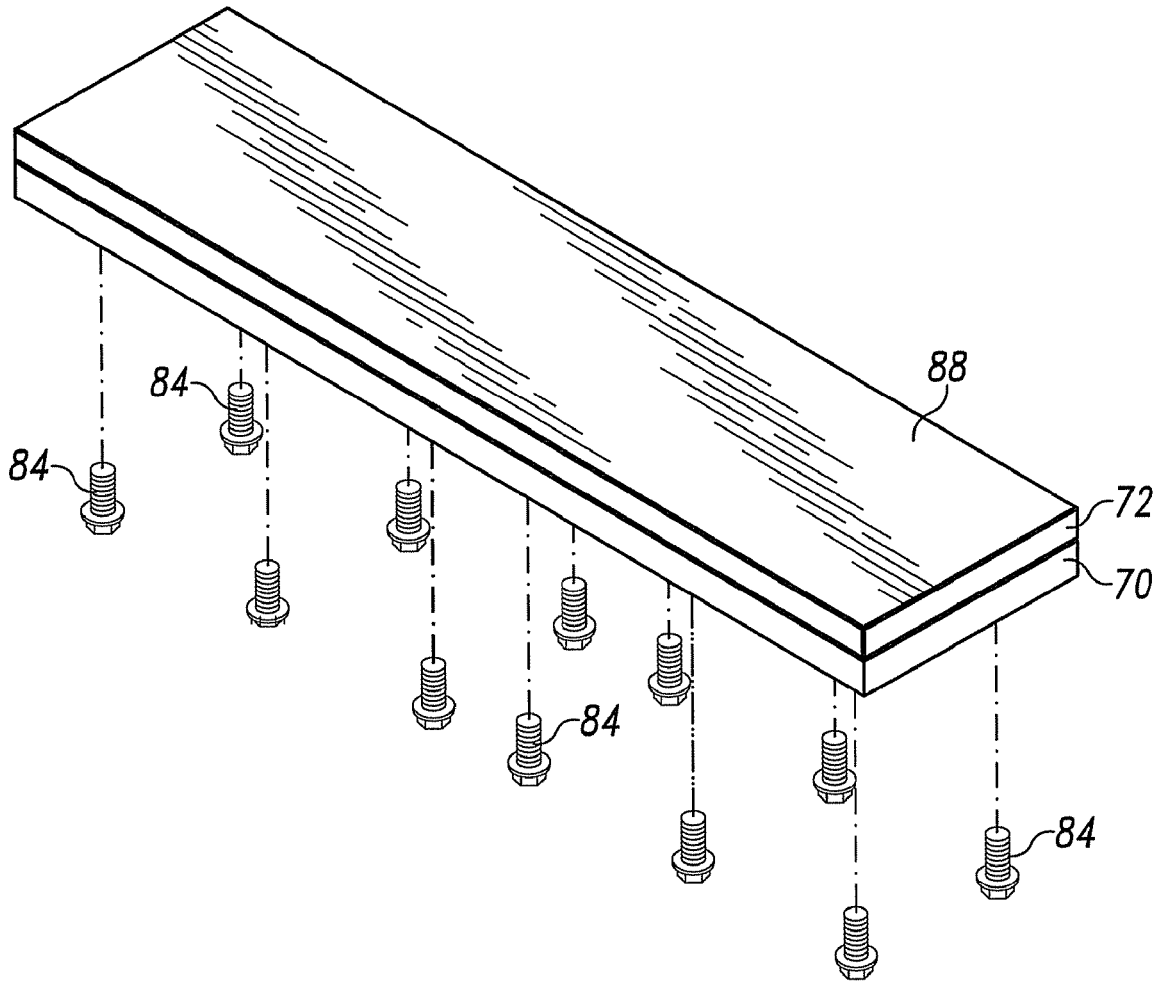
FIG. 6 is a view similar to FIGS. 4 and 5 showing the wear plate positioned on the outer surface of the flight plate, and the fasteners for coupling the two plates together still in an exploded view.

The flight plate 70 also has a second set of openings 82 passing between the outer surface 74 and the inner surface 76. The second set of openings 82 are adapted to receive a second plurality of bolts or other coupling elements 84. The second set of openings 82 are aligned with a set of openings 86 in the wear plate 72. The openings 86 are illustrated on the outer surface 88 of the wear plate 72, but in fact the openings 86 can be blind openings, as shown in FIG. 6, that only pass part way into the wear plate 72 from the inner surface 90 of the wear plate 72, thus leaving the outer surface 88 of the wear plate 72 completely clear of any obstruction. In either embodiment, the second set of coupling elements 84 are of sufficient length to pass from the flight plate inner surface 76 through the flight plate 70 and into engagement with the openings 86 in the wear plate 72, thereby securing the wear plate 72 to the flight plate 70.

Since the second set of coupling elements 84 to not extend to or above the outer surface 88 of the wear plate 72, the coupling elements 84 are not subjected to abrasive wear. Further, any number of sockets 52 can be fixed at any desired location to the outer surface 88 of the wear plate 72 without the need to avoid the presence of any fastening elements. As a result, an array of sockets 52 can be positioned on the outer surface 88 of the wear plate 72 at a higher or lower density, or with smaller or greater lateral variation in position to achieve a variety of cutting patterns and profiles for a given trencher 10. Furthermore, should one want to modify the cutting patterns or profiles, the wear plates 72 can be unbolted from the flight plates 70 and quickly replaced with new wear plates that can have differently positioned sockets 52. The flight plates 70 can be made of a more flexible alloy, while the wear plates 72 can be made of a tougher wear-resistant alloy to better endure the abrasion caused by the passing spoil.

Figure 7:
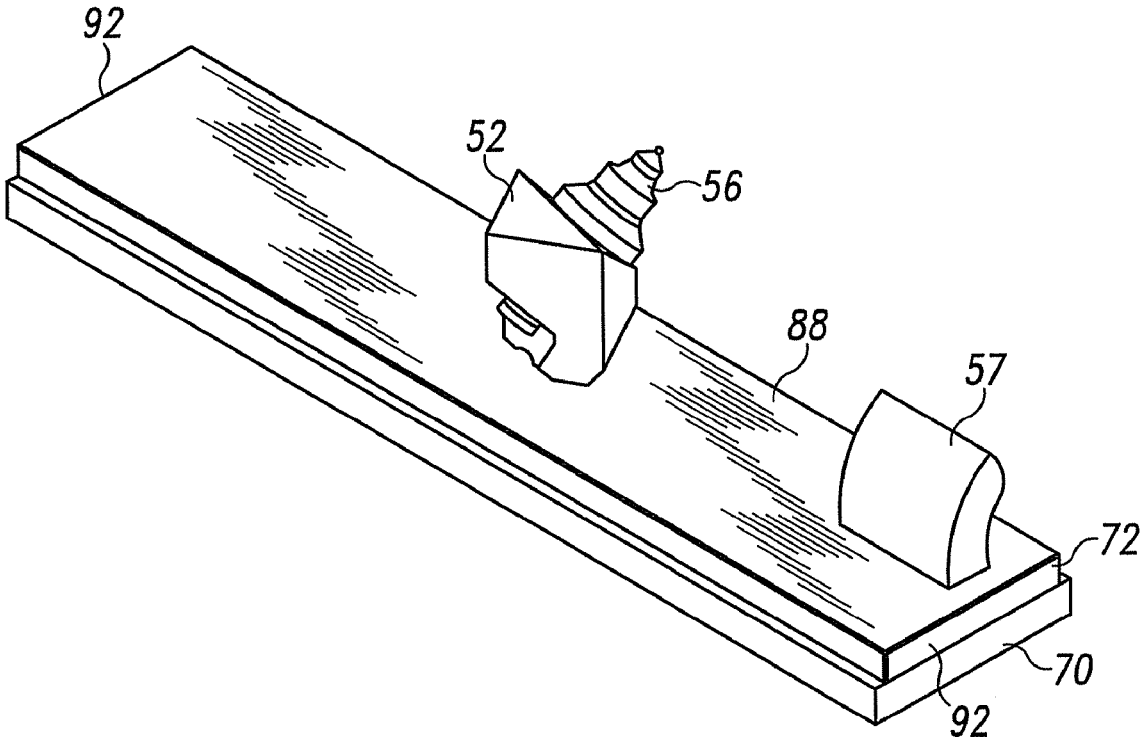
FIG. 7 is a view similar to FIGS. 4, 5 and 6 with the fasteners coupling the two plates together fully installed, and showing a first socket including a cutting element fixed to the wear plate.
Figure 8:
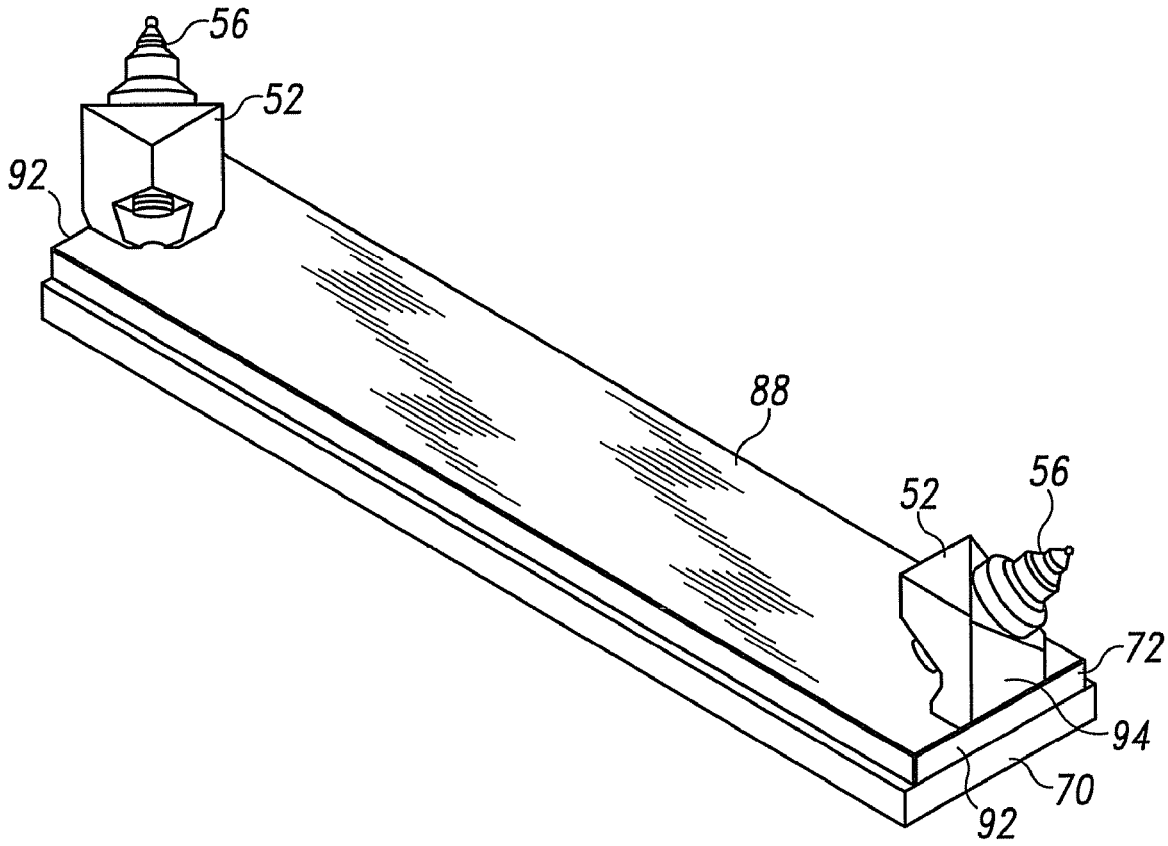
FIG. 8 is a view similar to FIG. 7 showing a second set of sockets with cutting elements fixed to the wear plate.

A preferred socket 52 is shown in FIGS. 7-11. The socket 52 can be welded at any location along the wear plate 72. When positioned in a central location, away from either end 92 of the wear plate 72, as shown, for example in FIG. 7, the socket 52 is generally aligned on the plate 72 so that the cutting element 56 is pointed in the direction of travel of the endless chain 42. When positioned immediately adjacent to either end 92 of the wear plate 72, as shown in FIG. 8, the socket can be rotated so that a face 94 of the socket 52 is aligned with the edge 92 of the plate 72, which causes the cutting element 56 to project laterally outward beyond the edge 92 of the plate 72. This lateral projection of the cutting element 56 ensures that the endless chain 42 will cut a trench of sufficient width to allow the boom assembly 20 to advance through the trench. Further, the positioning of the socket 52 as shown in FIG. 8 in order to achieve the desired lateral projection of the cutting element 56 can be accomplished without the need to cock or tilt the entire socket as was the general practice of the prior art. Additional paddles 57 can be secured to the wear plate 72 to assist in the removal of spoil from the ditch as shown in FIG. 7. The paddles 57 can be of any width but are generally shorter that the height of the combined socket 52 and cutting element 56. The paddles 57 can be welded to or bolted through the wear plate 72.

Figure 9:
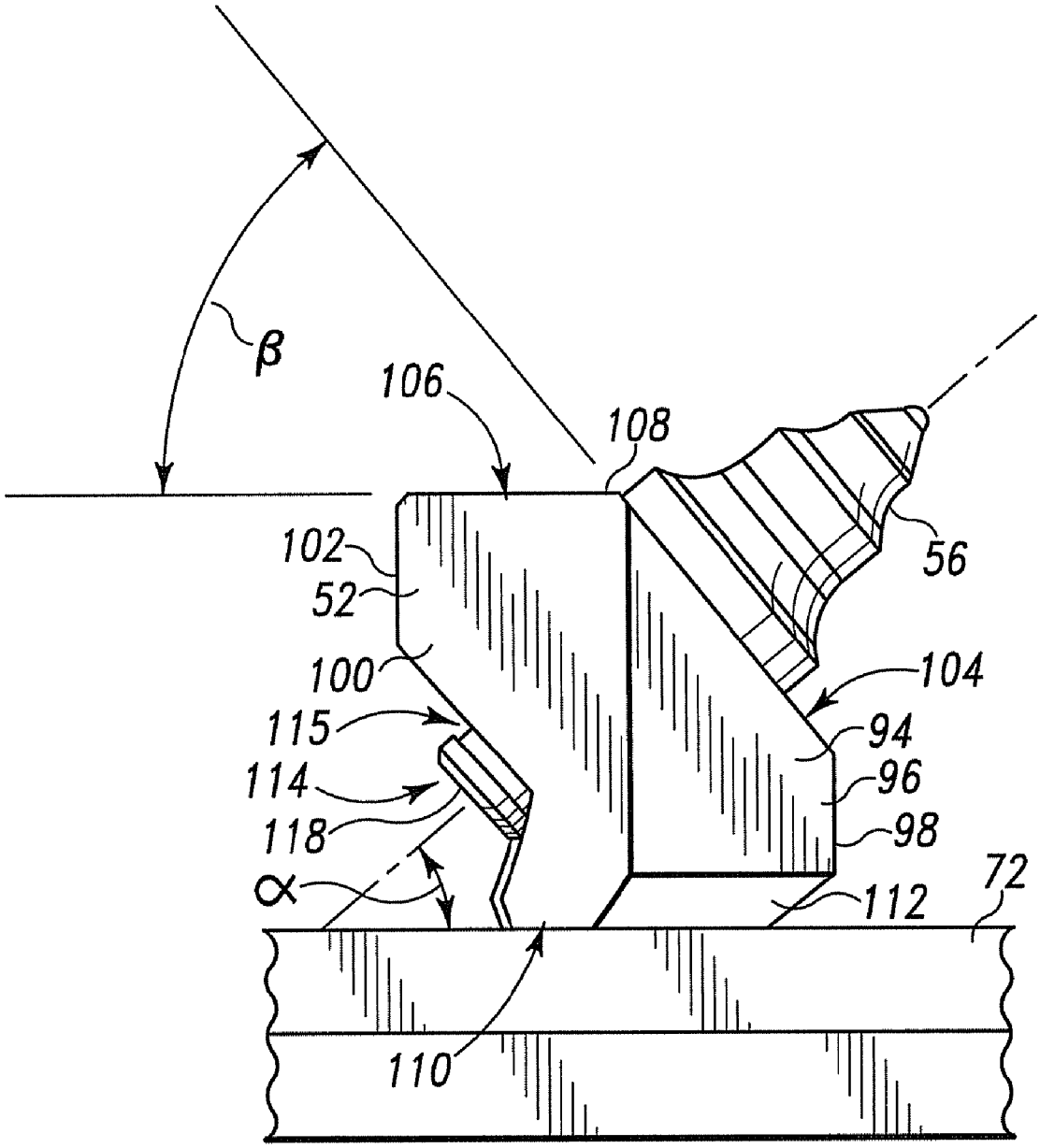
FIG. 9 is a first view of a preferred socket and cutting element.
Figure 10:
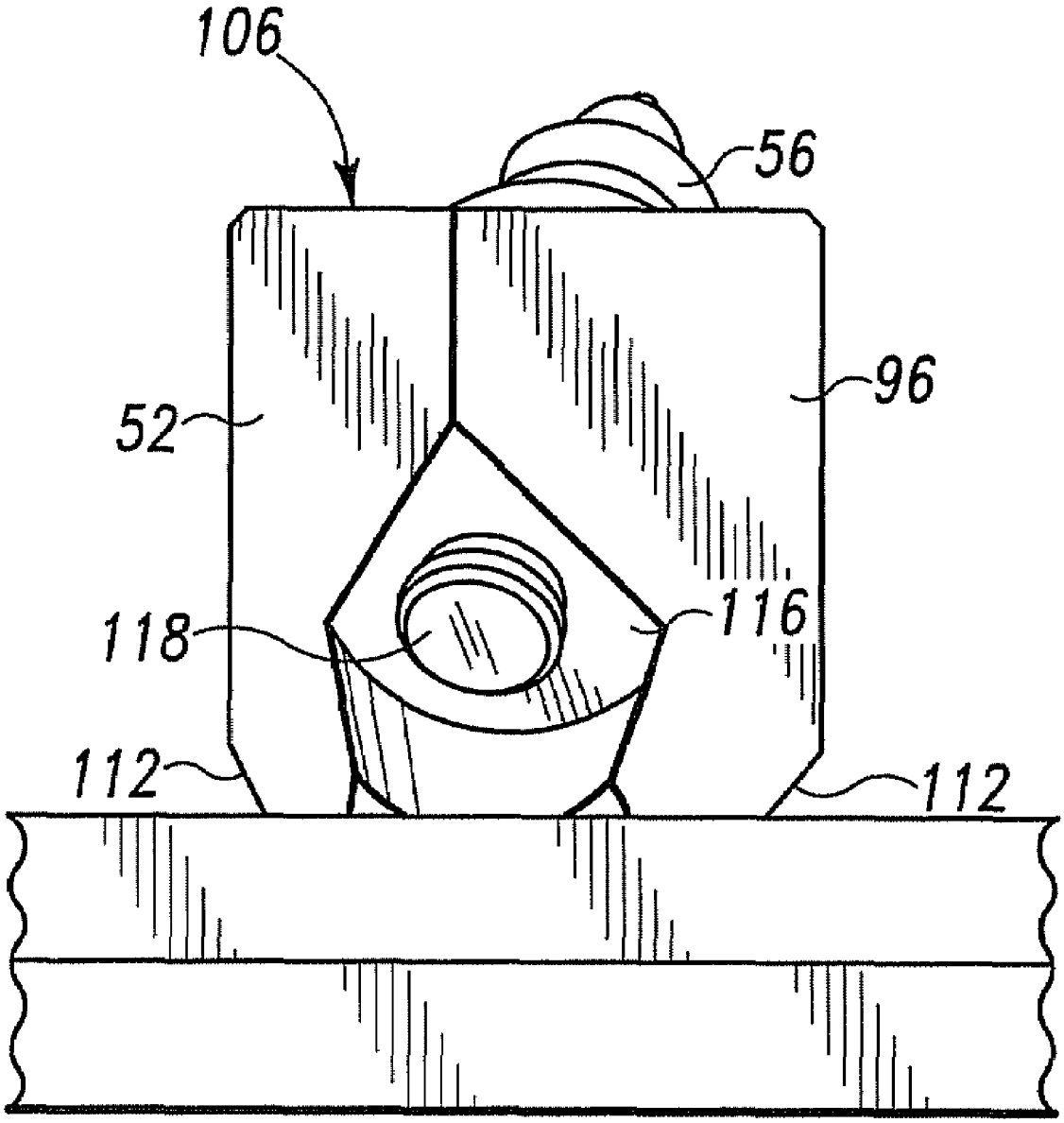
FIG. 10 is a second view of the socket and cutting element shown in FIG. 9.
Figure 11:
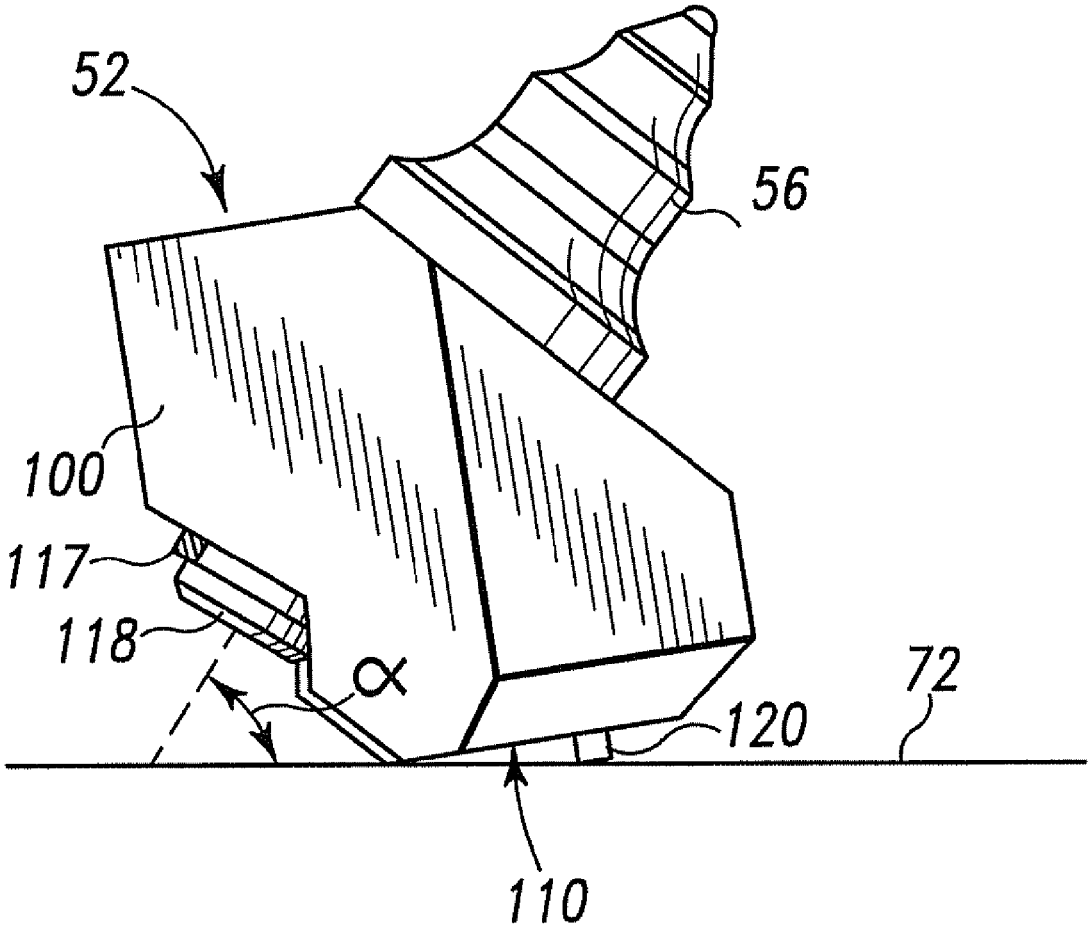
FIG. 11 is a side elevation view of another socket including an angle control pin to regulate the cutting angle of the tooth relative to the plate.

The preferred socket 52 is shown in detail in FIGS. 9-11 to comprise a body 96 having two forward faces 94 joined by a vertical edge 98. The body 96 also has two rearward faces 100 joined by vertical edge 102. An inclined surface 104 joins the top surface 106 of the body 96 to the two forward faces 94. An edge 108 joins the inclined surface 104 and top surface 106 at an angle $\beta$ of between about 40° and 55°. The body 96 also has a bottom surface 110 that is parallel to the top surface 106. The bottom surface 110 can be surrounded by a chamfer 112 suitable for receiving a weld line to facilitate the fixation of the socket 52 to the wear plate 72. A bore 114 extends into the socket 52 perpendicularly to the inclined surface 104 to receive the cutting element 56. As a result, the bore 114 is inclined with respect to the outer surface 88 of the wear plate 72 at an angle $\alpha$ that is complementary to the angle $\beta$. A back portion 116 between rearward faces 100 can be included to expose a lower end 118 of the cutting element 56 to facilitate removal of worn or spent cutting elements 56 from the socket 52. The cutting elements 56 can include a generally rectangular circumferential groove 115 as shown in FIG. 9 adjacent the exposed lower end 118 that can receive a retainer 117 for retaining the cutting element 56 in the socket 52 as shown in cross-section in FIG. 11. A preferred retainer 117 is in the form of an elastomeric ring having an inside diameter approximating the diameter of groove 115 and a width approximating the width of groove 115. The preferred sockets 52 having uniform bore and face angles, $\alpha$ and $\beta$, respectively, can be used at selected positions across the width of the wear plate 72 including at the end positions shown in FIG. 8, without any need to cock or tilt the entire socket as was the general practice of the prior art. Further, the preferred sockets 52 can be used in combination with endless trencher chains 42 having a construction other than is disclosed in this application.

Figure 12:
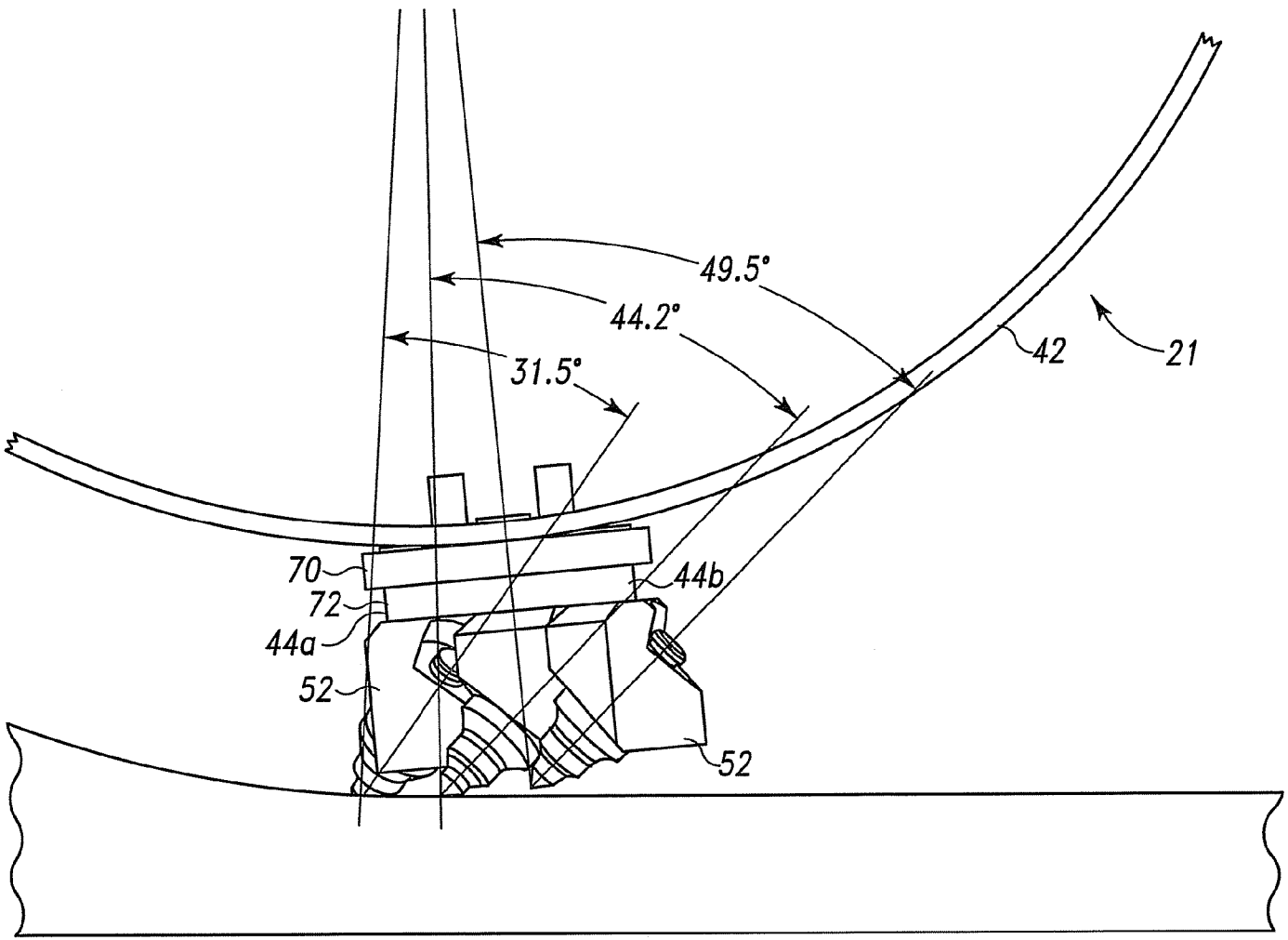
FIG. 12 is a schematic side elevation view of one plate of a toothed trencher track showing the variation in attack angle at the trench bottom based on the longitudinal position of the socket on the wear plate.
Figure 13:
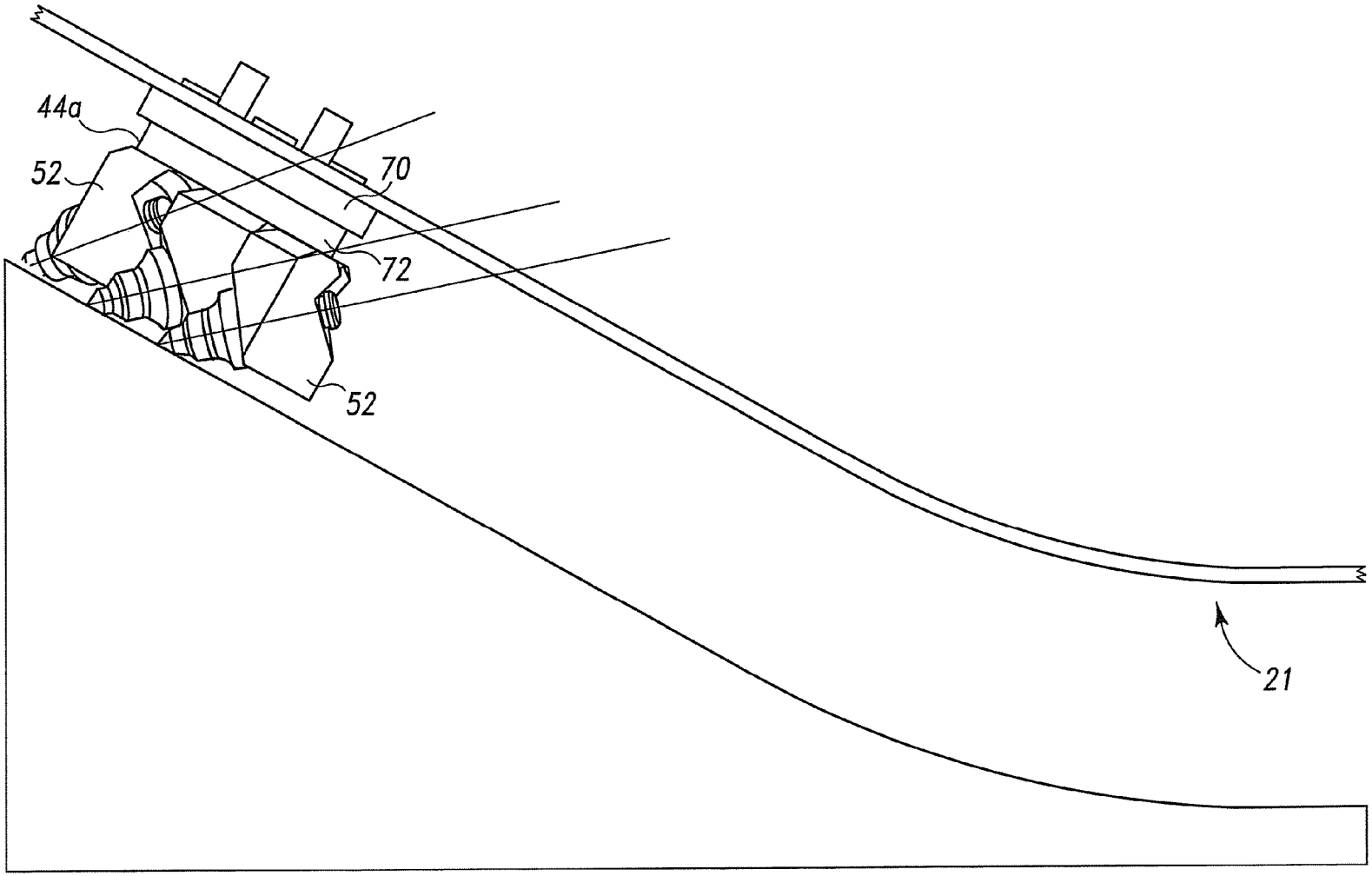
FIG. 13 is a schematic side elevation view similar to FIG. 12 showing the same plate when moved to the trench face.

In certain circumstances, it may be desirable to modify the attack angle of the cutting element 56. This can be accomplished by including an opening in the bottom surface 110 of the socket 52. A gauge pin 120 having a length chosen to tilt the socket 52 by a desired angle can be inserted into the bottom opening as shown in FIG. 11. The effect of the gauge pin 120 is to increase the angle α. By adopting gauge pins of selected fixed lengths, one can increase the angle α by a uniform amount for a selected set of the sockets 52 prior to being welded to the wear plate 72. The usefulness of this feature can better be appreciated by considering FIGS. 12 and 13, which show schematic side elevation views of a wear plate 72 having a plurality of sockets 52 fixed at varying longitudinal positions between the leading edge 44*a* and the trailing edge 44*b* of the same plate. The sockets in FIGS. 12 and 13 are fixed to the plate 72 as shown in FIG. 9 in the absence of a gauge pin 120. FIG. 12 shows the trench bottom attack angle δ measured between the axis of rotation of sprocket 46 and the bore 114 that receives the cutting element 56. While the angle of the bore 114 with respect to the surface for the plate 72 is the same for all illustrated sockets, the trench bottom attack angle δ is seen to vary between 31.5° and 49.5°. By selective use of gauge pins 120, one could reduce or even eliminate this variation in trench bottom attack angle based on longitudinal displacement of the sockets 52. Some variation in trench bottom angle might also be diminished by controlling the longitudinal position of the sockets 52 with respect to the leading and trailing edges. FIG. 13 shows that any variation in trench bottom attack angle tends to be minimized or even disappear on the trench face cut. Further it will be appreciated that the trench face is generally eliminated during the cutting process, while the side to side smoothness of the trench bottom can be of some importance. It will also be appreciated that a gauge pin 120 can be off-set to one side or another of the base of the sockets 52 to define an angular tilt that may be desired when securing the socket 52 to the wear plate 72.

Figure 14:
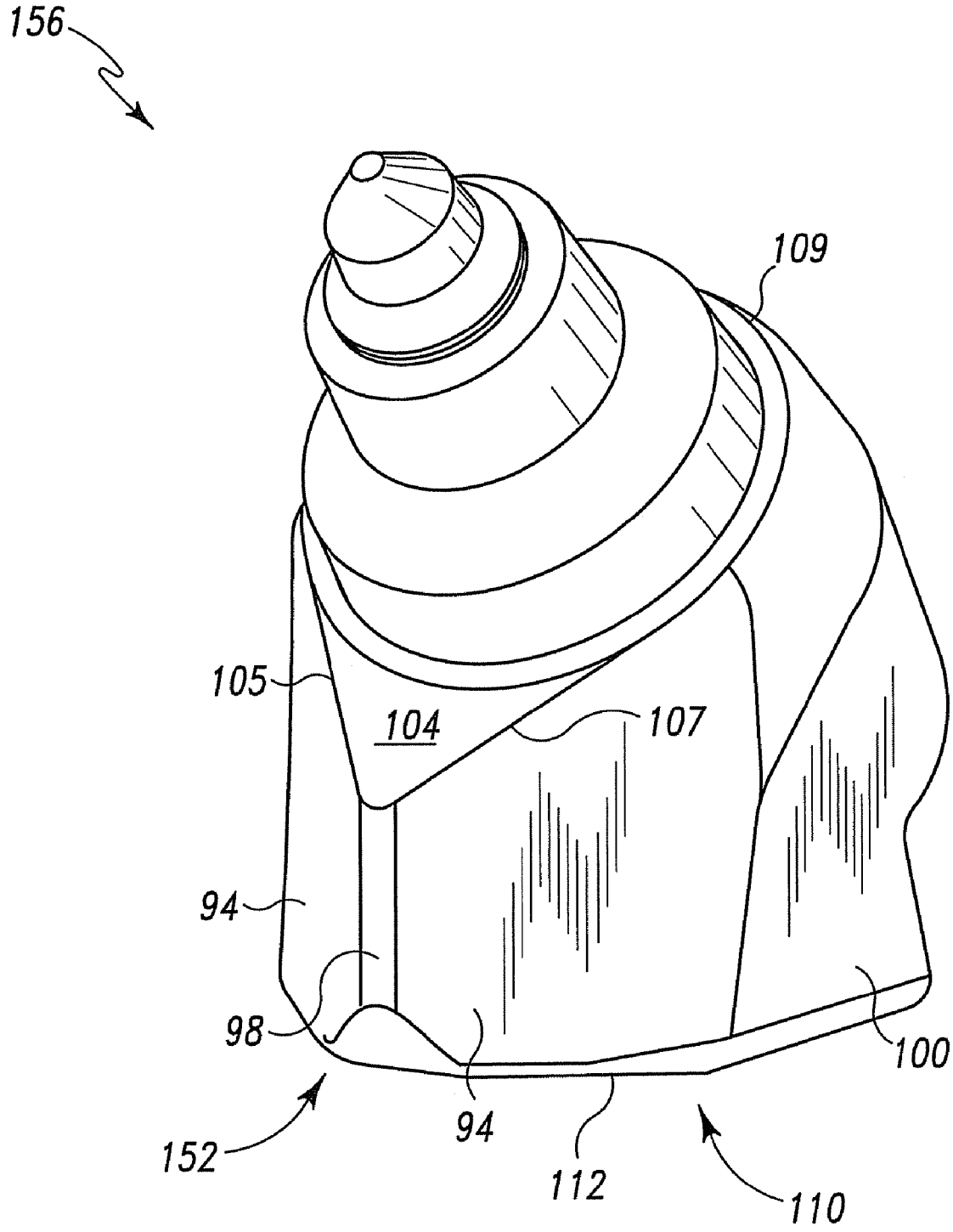
FIG. 14 is a front perspective view of a second preferred socket and cutting element.
Figure 15:
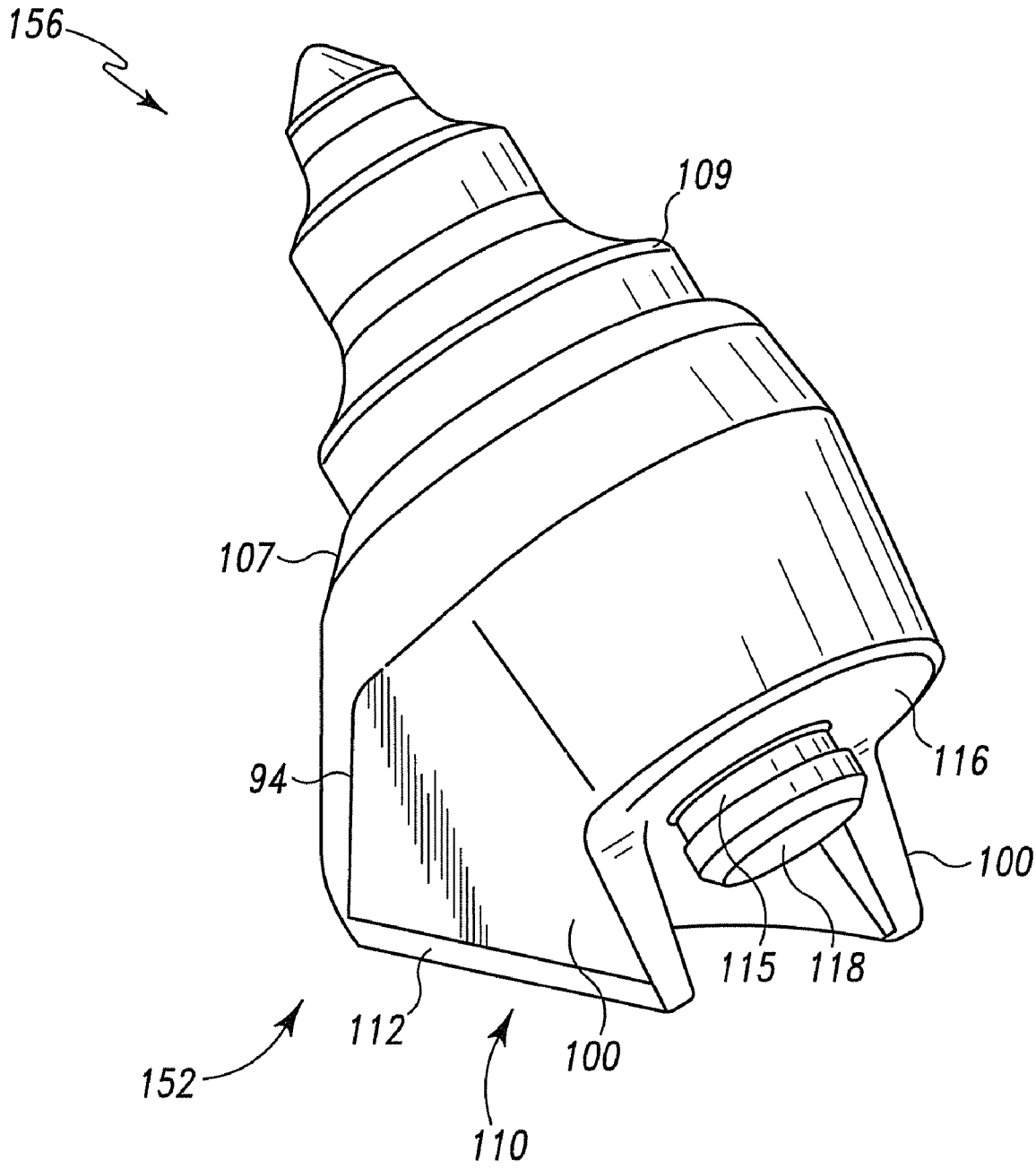
FIG. 15 is a rear perspective view of the second preferred socket and cutting element shown in FIG. 14.

Another preferred socket 152 with an included cutting element 156 is shown in FIGS. 14 and 15. The preferred socket 152 is shown to have two forward faces 94 joined by a vertical edge 98. An inclined surface 104 joins the two forward faces 94 along inclined edges 105 and 107. An arcuate edge 109 outlines the upper extent of the inclined surface 104. The inclined surface 104 can be inclined at an angle similar to inclined surface 104 of socket 52 shown in FIGS. 7-11. The socket 152 has a bottom surface 110 that can be surrounded by a chamfer 112 suitable for receiving a weld line to facilitate the fixation of the socket 152 to the wear plate 72. A bore extends into the socket 152 perpendicularly to the inclined surface 104 to receive the cutting element 156. As a result, the bore is inclined with respect to the outer surface 88 of the wear plate 72 at an angle α that can be similar to inclined bore 114 of socket 52 shown in FIGS. 7-11. A back portion 116 between rearward faces 100 can be included to expose a lower end 118 of the cutting element 156 to facilitate removal of worn or spent cutting elements 156 from the socket 152. The cutting elements 156 can include a generally rectangular circumferential groove 115 adjacent the exposed lower end 118 that can receive a retainer 117 for retaining the cutting element 156 in the socket 152 similar to that shown in cross-section in FIG. 11 with respect to cutting elements 56. A preferred retainer 117 is in the form of an elastomeric ring having an inside diameter approximating the diameter of groove 115 and a width approximating the width of groove 115.

The preferred sockets 152 having uniform bore and face angles can be used at selected positions across the width of the wear plate 72 including at the end positions shown in FIG. 8, without any need to cock or tilt the entire socket as was the general practice of the prior art. Further, the preferred sockets 152 can be used in combination with endless trencher chains 42 having a construction other than is disclosed in this application. In certain circumstances, it may be desirable to modify the attack angle of the cutting element 156. This can be accomplished by including an opening in the bottom surface 110 of the socket 152. A gauge pin 120 having a length chosen to tilt the socket 152 by a desired angle can be inserted into the bottom opening similar to that shown in FIG. 11. The effect of the gauge pin 120 is to increase the attack angle α. By adopting gauge pins of selected fixed lengths, one can increase the attack angle α by a uniform amount for a selected set of the sockets 152 prior to being welded to the wear plate 72. It will also be appreciated that a gauge pin 120 can be off-set to one side or another of the base of the sockets 152 to define an angular tilt that may be desired when securing the socket 152 to the wear plate 72.

In accordance with the provisions of the patent statutes, the present invention has been described in what is considered to represent its preferred embodiment. However, it should be noted that the invention can be practiced otherwise than as specifically illustrated and described.

The invention claimed is:

1. An endless chain for cutting and removing spoil from a trench, the endless chain comprising:
   - a plurality of adjacent links, and pivot rods pivotally coupling adjacent links end to end to each other, the pivot rods at the ends of each link defining a plane;
   - a plurality of flight plates secured to the plurality of links, the flight plates including an under surface, parallel to said plane, confronting the links and having a pattern of openings extending through each flight plate between the under surface and an outer surface;
   - a plurality of wear plates positioned over the outer surface of the plurality of flight plates, each wear plate having at least one cutting element mounted onto an outer surface of the wear plate; and
   - a plurality of fasteners passing through some of the pattern of openings from the under surface of the flight plate to secure the wear plates to the flight plates.

2. The endless chain of claim 1, further comprising: a second plurality of links and wherein each flight plate is secured to at least two links including at least one link from the second plurality of links.

3. The endless chain of claim 1, further comprising: a set of fasteners passing through some of the pattern of openings from the flight plate outer surface to the chain links to secure the fight plates to the chain links, the set a fasteners being recessed into the flight plate outer surface.

4. The endless chain of claim 1, wherein each wear plate includes blind openings to receive the plurality of fasteners securing the wear plates to the flight plates.

5. The endless chain of claim 1, wherein the plurality of fasteners securing the wear plates to the flight plates terminate short of the outer surface of the wear plate.

6. The endless chain of claim 1, wherein the cutting elements are secured to the outer surface of the wear plates in a tapering pattern extending over a plurality of adjacent wear plates.

7. The endless chain of claim 1, further comprising sockets fixed to the outer surface of the wear plates, each socket holding one of the cutting elements.

8. The endless chain of claim 7, wherein each of the sockets includes an inclined opening for receiving one of the cutting elements situated at an angle with respect to the outer surface of the wear plates of between about 35° and 60°.

9. The endless chain of claim 8, wherein at least one of the sockets further includes a gauge pin situated between the socket lower surface and the outer surface of the wear plate.

10. The endless chain of claim 7, wherein each of the sockets includes two faces joined by a perpendicular ridge, the ridge defining a vertical line intersecting the cutting element held by the socket.

11. The endless chain of claim 1, wherein the wear plates are composed of a harder alloy that the flight plates.

12. An endless chain for cutting and removing spoil from a trench, the endless chain comprising:

a plurality of adjacent links, and pivot rods pivotally coupling adjacent links end to end to each other, adjacent pivot rods of each link defining a plane;

a plurality of flight plates, the flight plates including an under surface and an outer surface generally parallel to said plane, confronting the links and having a pattern of openings extending through each flight plate between the under surface and the outer surface;

a set of fasteners passing through some of the pattern of openings from each flight plate outer surface to the chain links to secure the fight plates to the chain links, the set a fasteners including heads fully recessed into the flight plate outer surface;

a plurality of wear plates positioned over the outer surface of the plurality of flight plates; and a plurality of fasteners passing through some of the pattern of openings from the under surface of each flight plate into each overlying wear plate to secure the wear plates to the flight plates.

13. The endless chain of claim 12, wherein each wear plate includes blind openings to receive the plurality of fasteners securing the wear plates to the flight plates, and wherein each of the plurality of fasteners securing the wear plates to the flight plates includes an outer end terminating short of the outer surface of the wear plate.

14. The endless chain of claim 12, further comprising: at least a second plurality of links and wherein each flight plate is secured to at least two links including at least one link from the second plurality of links.

15. The endless chain of claim 12, further comprising at least one socket fixed to the outer surface of at least some of the wear plates, each socket including an inclined opening situated at an angle with respect to the outer surface of the wear plates of between about 35° and 60°, each inclined opening receiving a cutting element.

16. The endless chain of claim 15, further comprising at least one paddle secured to the outer surface of at least some of the wear plates to assist in the removal of spoil.

17. The endless chain of claim 16, wherein the at least one paddle is shorter that the combined socket and cutting element height.

18. The endless chain of claim 15, wherein at least some of the sockets further includes a gauge pin situated between the socket lower surface and the outer surface of the wear plate.

19. The endless chain of claim 15, wherein at least some of the wear plates have at least two sockets fixed to the outer surface thereof, the sockets in adjacent wear plates being arranged in a tapering pattern extending over a plurality of adjacent wear plates.

20. An endless chain for cutting and removing spoil from a trench, the endless chain comprising:

a plurality of adjacent links, and pivot rods pivotally coupling adjacent links end to end to each other, adjacent pivot rods of each link defining a plane;

a plurality of flight plates, the flight plates including an under surface and an outer surface essentially parallel to said plane, confronting the links and having a pattern of openings extending through each flight plate between the under surface and the outer surface;

a set of fasteners passing through some of the pattern of openings from each flight plate outer surface to the chain links to secure the fight plates to the chain links, the set a fasteners including heads fully recessed into the flight plate outer surface;

a plurality of wear plates positioned contiguously to the outer surface of the plurality of flight plates;

a plurality of fasteners passing through some of the pattern of openings from the under surface of each flight plate into each contiguous wear plate to secure the wear plates to the flight plates, the plurality of fasteners having outer ends situated at or short of the outer surface of the wear plates; and at least one socket fixed to the outer surface of at least some of the wear plates, each socket including an inclined opening, each inclined opening receiving a cutting element.

21. The endless chain of claim 20, further comprising at least one paddle secured to the outer surface of at least some of the wear plates to assist in the removal of spoil, each paddle being shorter that the combined socket and cutting element height.

22. The endless chain of claim 20, wherein at least some of the sockets further includes a gauge pin situated between the socket lower surface and the outer surface of the wear plate to position the inclined opening at an angle with respect to the outer surface of the wear plate of between about 35° and 60°.

23. The endless chain of claim 20, wherein each wear plate includes blind openings to receive the plurality of fasteners securing the wear plates to the flight plates.

24. The endless chain of claim 20, further comprising: at least a second plurality of links and wherein each flight plate is secured to at least two links including at least one link from the second plurality of links.

25. The endless chain of claim 20, wherein at least some of the wear plates have at least two sockets fixed to the outer surface thereof, the sockets in adjacent wear plates being arranged in a tapering pattern extending over a plurality of adjacent wear plates.

* * * * *

UNITED STATES PATENT AND TRADEMARK OFFICE

CERTIFICATE OF CORRECTION

PATENT NO. : 7,665,235 B2
APPLICATION NO. : 12/051344
DATED : February 23, 2010
INVENTOR(S) : Winchester E. Latham It is certified that error appears in the above-identified patent and that said Letters Patent is hereby corrected as shown below:

In the Claims

In Column 9, Line 13, please delete "that" and insert --than--.

In Column 9, Line 57, please delete "that" and insert --than--.

In Column 10, Line 22, please delete "a" and insert --of--.

In Column 10, Line 39, please delete "that" and insert --than--.

Signed and Sealed this

Sixth Day of April, 2010

David J. Kappos

David J. Kappos
*Director of the United States Patent and Trademark Office*